US009904207B2

(12) United States Patent
Arai

(10) Patent No.: US 9,904,207 B2
(45) Date of Patent: Feb. 27, 2018

(54) IMAGE FORMATION APPARATUS, IMAGE FORMATION SYSTEM, CONTROL METHOD, AND NON-TRANSITORY RECORDING MEDIUM

(71) Applicant: Konica Minolta, Inc., Chiyoda-ku, Tokyo (JP)

(72) Inventor: Daisuke Arai, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/361,519

(22) Filed: Nov. 28, 2016

(65) Prior Publication Data

US 2017/0168417 A1 Jun. 15, 2017

(30) Foreign Application Priority Data

Dec. 15, 2015 (JP) ..... 2015-244281

(51) Int. Cl.
*G03G 15/08* (2006.01)

(52) U.S. Cl.
CPC ..... *G03G 15/0831* (2013.01); *G03G 15/0856* (2013.01); *G03G 15/0879* (2013.01)

(58) Field of Classification Search
None
See application file for complete search history.

(56) References Cited

U.S. PATENT DOCUMENTS

2009/0214229 A1* 8/2009 Joo ..... G03G 15/0872 399/27
2011/0311243 A1* 12/2011 Kawai ..... G03G 15/5079 399/28
2012/0243886 A1* 9/2012 Sunayama ..... G03G 15/0856 399/27

FOREIGN PATENT DOCUMENTS

JP 2002132039 A 5/2002
JP 2009210743 A 9/2009
JP 2013097005 A 5/2013

* cited by examiner

*Primary Examiner* — Thomas Giampaolo, II
(74) *Attorney, Agent, or Firm* — Buchanan Ingersoll & Rooney PC

(57) ABSTRACT

An image formation apparatus includes a toner bottle, a sub hopper configured to temporarily store toner supplied from the toner bottle, a development apparatus configured to receive supply of the toner from the sub hopper, a first detector configured to detect a remaining amount of toner in the toner bottle, a second detector configured to detect an empty space for toner in the sub hopper, and a controller configured to have the toner supplied from the toner bottle to the sub hopper each time the empty space in the sub hopper exceeds a threshold value Th1. When the remaining amount of toner in the toner bottle is smaller than a threshold value ThA, the controller lowers the threshold value Th1 to a threshold value Th2.

14 Claims, 15 Drawing Sheets

FIG.7

| STATE OF TONER | | CONDITION FOR TRANSITION | NOTIFICATION | CONTENTS OF REPRESENTATION |
|---|---|---|---|---|
| <STATE A> NORMAL | 70 TB : TONER PRESENT<br>SB : FULL 72 | REMAINING AMOUNT OF TONER≥ThA (SUFFICIENT REMAINING AMOUNT OF TONER) | — | — |
| <STATE B> NEAR EMPTY | 70 TB : ONLY A SMALL AMOUNT REMAINING<br>SB : FULL 72 | REMAINING AMOUNT OF TONER<ThA (DETECT WITH SOFTWARE) | NEAR EMPTY | PREPARE NEW TONER BOTTLE |
| <STATE C> EMPTY (PRINTING PERMITTED) | 70 TB : NO TONER REMAINING<br>SB : CORRESPONDING TO 1K COPIES 72 | DETECTION THREE TIMES WITH EMPTY SENSOR (DETECTION WITH HARDWARE) | EMPTY | TIME TO REPLACE TONER BOTTLE |
| <STATE D> EMPTY (PRINTING PROHIBITED) | 70 TB : NO TONER REMAINING<br>SB : NO TONER REMAINING (ONLY A SMALL AMOUNT REMAINING) 72 | AFTER CONSUMPTION OF 10 g OF AMOUNT OF SUPPLY TO DEVELOPMENT APPARATUS FROM "EMPTY (PRINTING PERMITTED)" (DETECTED WITH SOFTWARE) | EMPTY | REPLACE TONER BOTTLE |

TB : TONER BOTTLE
SB : SUB HOPPER

FIG.15

130

| TONER BOTTLE | TIMING OF REPLACEMENT |
|---|---|
| TONER BOTTLE A | MAY 10, 2015 |
| TONER BOTTLE A | JUNE 10, 2015 |
| TONER BOTTLE A | JULY 20, 2015 |
| TONER BOTTLE B | MAY 10, 2015 |
| TONER BOTTLE B | JUNE 5, 2015 |
| ⋮ | ⋮ |

IMAGE FORMATION APPARATUS, IMAGE FORMATION SYSTEM, CONTROL METHOD, AND NON-TRANSITORY RECORDING MEDIUM

This application is based on Japanese Patent Application No. 2015-244281 filed with the Japan Patent Office on Dec. 15, 2015, the entire content of which is hereby incorporated by reference.

BACKGROUND OF THE INVENTION

Field of the Invention

The present disclosure relates to control of an image formation apparatus and particularly to control of an image formation apparatus of an electrophotography type.

Description of the Related Art

An image formation apparatus of an electrophotography type has widely been used. The image formation apparatus of the electrophotography type performs, as print processing, evenly charging a photoconductor while the photoconductor is rotated, forming an electrostatic latent image by exposing the photoconductor, attaching toner to the electrostatic latent image on the photoconductor, and transferring a toner image on the photoconductor to a printed matter.

A toner bottle can be attached to an image formation apparatus. The toner bottle supplies toner to a sub hopper. The sub hopper temporarily stores toner supplied from the toner bottle and supplies the toner to a development apparatus. As the toner is supplied from the development apparatus to a photoconductor, a toner image is developed on the photoconductor.

As a remaining amount of toner in the toner bottle decreases, a user of the image formation apparatus replaces the toner bottle. If the toner bottle is replaced with a large amount of toner remaining, toner will be wasted. Therefore, toner which remains in the toner bottle is preferably supplied to the sub hopper before the toner bottle is replaced.

In connection with a method of supplying toner from a toner bottle, Japanese Laid-Open Patent Publication No. 2009-210743 discloses an image forming apparatus "that is capable of reducing work burdens imposed on a user in terms of toner cartridge replacement." Japanese Laid-Open Patent Publication No. 2002-132039 discloses an image recording apparatus "capable of using toner without waste by preventing such a disadvantage that determination as toner not being left is made with a large amount of usable toner remaining." Japanese Laid-Open Patent Publication No. 2013-97005 discloses an image formation apparatus "which determines whether or not replacement of a toner bottle is necessary by sensing load imposed on a toner bottle motor."

In order to decrease a remaining amount of toner by the time of replacement of a toner bottle, toner is preferably supplied to a sub hopper as much as possible before replacement of the toner bottle. It is generally difficult, however, to accurately predict timing of replacement of a toner bottle.

In order to decrease a remaining amount of toner by the time of replacement of a toner bottle, it is also possible to periodically supply toner in a toner bottle to a sub hopper as much as possible. If toner is supplied to the sub hopper with a large amount of toner remaining in the toner bottle, however, an amount of supply of toner will not be stable and toner may spill out of the sub hopper.

Therefore, an image formation apparatus capable of decreasing a remaining amount of toner by the time of replacement of a toner bottle while supply of toner from the toner bottle to a sub hopper is stabilized has been desired. Patent Documents 1 to 3 do not disclose an image formation apparatus which achieves both decrease in remaining amount of toner by the time of replacement of a toner bottle and stabilization of supply of toner from the toner bottle to a sub hopper.

SUMMARY OF THE INVENTION

An object in one aspect of the present disclosure is to provide an image formation apparatus capable of decreasing a remaining amount of toner by the time of replacement of a toner bottle while supply of toner from the toner bottle to a sub hopper is stabilized. An object in another aspect is to provide an image formation system capable of decreasing a remaining amount of toner by the time of replacement of a toner bottle while supply of toner from the toner bottle to a sub hopper is stabilized. An object in yet another aspect is to provide a control method which allows decrease in remaining amount of toner by the time of replacement of a toner bottle while supply of toner from the toner bottle to a sub hopper is stabilized. An object in still another aspect is to provide a non-transitory recording medium storing a control program which allows decrease in remaining amount of toner by the time of replacement of a toner bottle while supply of toner from the toner bottle to a sub hopper is stabilized.

According to one aspect, an image formation apparatus includes a toner bottle, a storage portion which temporarily stores toner supplied from the toner bottle, a development portion which receives supply of toner from the storage portion, a first detector which detects a remaining amount of toner in the toner bottle, a second detector which detects an empty space for toner in the storage portion, and a controller which has toner supplied from the toner bottle to the storage portion each time the empty space exceeds a prescribed threshold value. The controller lowers the prescribed threshold value from a current value when a remaining amount of toner in the toner bottle is smaller than a prescribed amount.

Preferably, the controller lowers the prescribed threshold value as the remaining amount of toner in the toner bottle is smaller.

Preferably, the image formation apparatus further includes a display. The display shows contents for having a new toner bottle prepared when the remaining amount of toner is smaller than the prescribed amount.

Preferably, the display shows contents for inviting replacement of the toner bottle when the remaining amount of toner is smaller than a predetermined amount smaller than the prescribed amount.

Preferably, the image formation apparatus further includes a prohibition unit which prohibits printing by the image formation apparatus when the remaining amount of toner is smaller than the predetermined amount and when the empty space exceeds the prescribed threshold value.

Preferably, the image formation apparatus further includes a setting unit which accepts whether or not to activate change in prescribed threshold value by the controller.

Preferably, the image formation apparatus further includes a setting unit which accepts setting of the prescribed threshold value.

Preferably, the image formation apparatus further includes a communication unit which transmits a request for ordering a new toner bottle to a server when the remaining amount of toner is smaller than the prescribed amount.

Preferably, the communication unit can receive a command for transmitting the request to the server from another image formation apparatus or the server. The controller lowers the prescribed threshold value from the current value based on reception of the command.

Preferably, the controller lowers the prescribed threshold value from the current value based on transmission of the request to the server.

Preferably, the image formation apparatus further includes a storage unit which holds a history of replacement of the toner bottle and an estimation unit which estimates next timing of replacement of the toner bottle based on the history of replacement. The controller lowers the prescribed threshold value as the next timing of replacement is nearer.

According to another aspect, an image formation system including a plurality of image formation apparatuses and a server which communicates with the plurality of image formation apparatuses is provided. Each of the image formation apparatuses includes a toner bottle, a storage portion which temporarily stores toner supplied from the toner bottle, a development portion which receives supply of toner from the storage portion, a first detector which detects a remaining amount of toner in the toner bottle, a second detector which detects an empty space for toner in the storage portion, a first controller which has toner supplied from the toner bottle to the storage portion each time the empty space exceeds a prescribed threshold value, and a communication unit which transmits a request for ordering a new toner bottle to the server when a remaining amount of toner in the toner bottle is smaller than a prescribed amount. The server includes a second controller which performs, in response to reception of the request from one image formation apparatus among the plurality of image formation apparatuses, processing for ordering a new toner bottle for another image formation apparatus which satisfies a prescribed ordering condition among the plurality of image formation apparatuses and the one image formation apparatus and gives a mode switching instruction to instruct the image formation apparatus for which the server has performed the ordering processing to switch to a mode for lowering the prescribed threshold value. The first controller lowers the prescribed threshold value from a current value in response to the mode switching instruction from the server.

According to yet another aspect, a method of controlling an image formation apparatus which communicates with a server is provided. The image formation apparatus includes a toner bottle, a storage portion which temporarily stores toner supplied from the toner bottle, and a development portion which receives supply of toner from the storage portion. The method includes detecting a remaining amount of toner in the toner bottle, detecting an empty space for toner in the storage portion, supplying toner from the toner bottle to the storage portion each time the empty space exceeds a prescribed threshold value, the image formation apparatus transmitting a request for ordering a new toner bottle to the server when a remaining amount of toner in the toner bottle is smaller than a prescribed amount, the server searching for another image formation apparatus which satisfies a prescribed ordering condition among a plurality of the image formation apparatuses in response to reception of the request from one image formation apparatus among the plurality of image formation apparatuses, the server performing processing for ordering a new toner bottle for the one image formation apparatus and another image formation apparatus which satisfies the prescribed ordering condition, the server giving a mode switching instruction instructing the image formation apparatus for which the server has performed the ordering processing to switch to a mode for lowering the prescribed threshold value, and the image formation apparatus lowering the prescribed threshold value from a current value in response to the mode switching instruction from the server.

According to still another aspect, a control program executed by a server which communicates with a plurality of image formation apparatuses is provided. The image formation apparatus includes a toner bottle, a storage portion which temporarily stores toner supplied from the toner bottle, a development portion which receives supply of toner from the storage portion, a first detector which detects a remaining amount of toner in the toner bottle, a second detector which detects an empty space for toner in the storage portion, a controller which has toner supplied from the toner bottle to the storage portion each time the empty space exceeds a prescribed threshold value, and a communication unit which transmits a request for ordering a new toner bottle to the server when a remaining amount of toner in the toner bottle is smaller than a prescribed amount. The control program causes the server to perform searching, in response to reception of the request from one image formation apparatus among the plurality of image formation apparatuses, for another image formation apparatus which satisfies a prescribed ordering condition among the plurality of image formation apparatuses, performing processing for ordering a new toner bottle for the one image formation apparatus and another image formation apparatus which satisfies the prescribed ordering condition, and instructing the image formation apparatus for which the server has performed the ordering processing to switch to a mode lower in the prescribed threshold value.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7 is a diagram showing one example of a manner of representation on the image formation apparatus in accordance with a remaining amount of toner in the toner bottle and the sub hopper.

FIG. 15 is a diagram showing contents in a history of replacement of a toner bottle.

DESCRIPTION OF THE PREFERRED EMBODIMENTS

Figure 1:
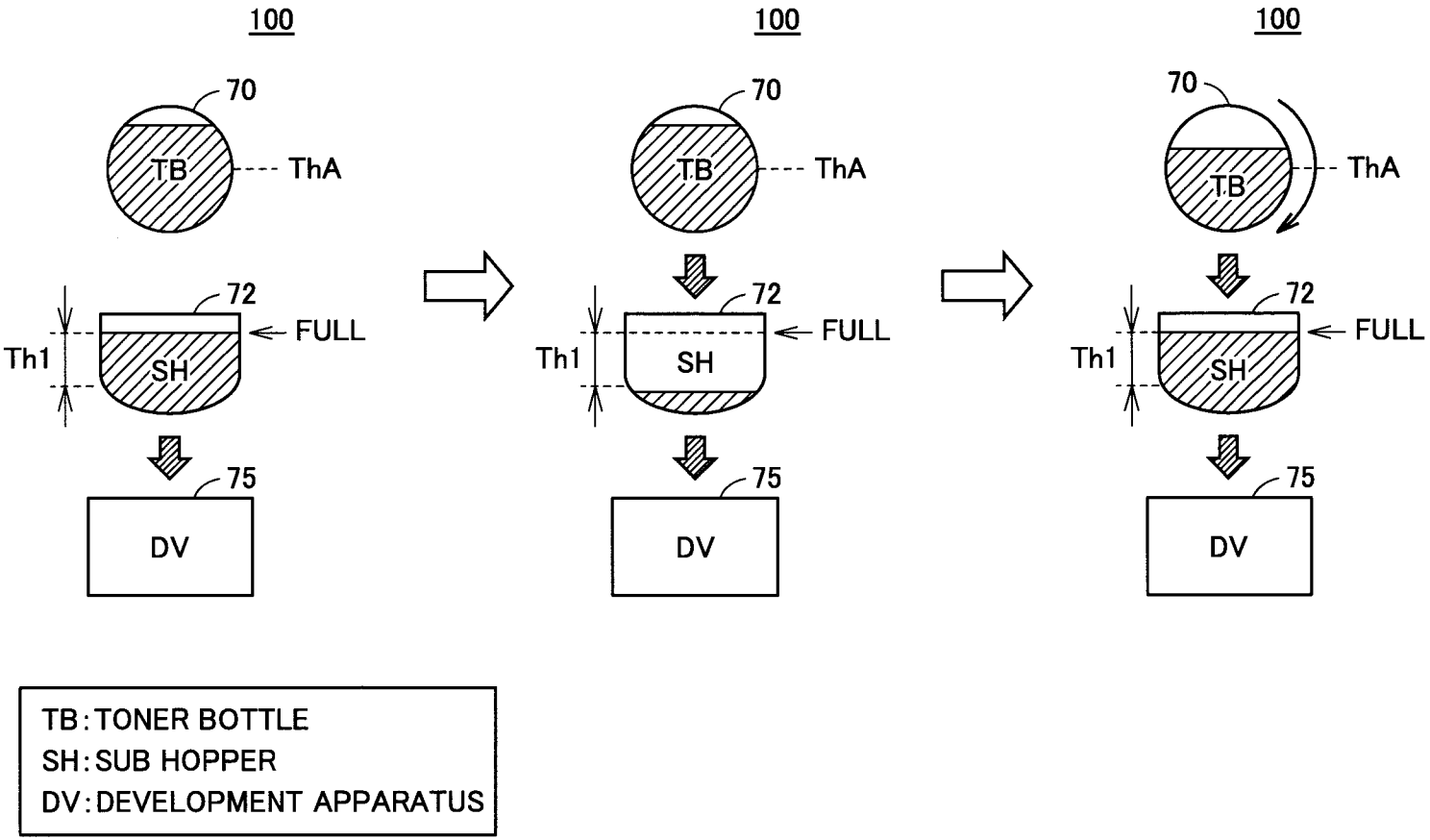
FIG. 1 is a diagram showing a process for supplying toner when a remaining amount of toner in a toner bottle is large.

Each embodiment according to the present invention will be described hereinafter with reference to the drawings. In the description below, the same elements and components have the same reference characters allotted. Their label and function are also identical. Therefore, detailed description thereof will not be repeated. Each embodiment and each modification described below may selectively be combined as appropriate.

First Embodiment

[Method of Supplying Toner]

Figure 2:
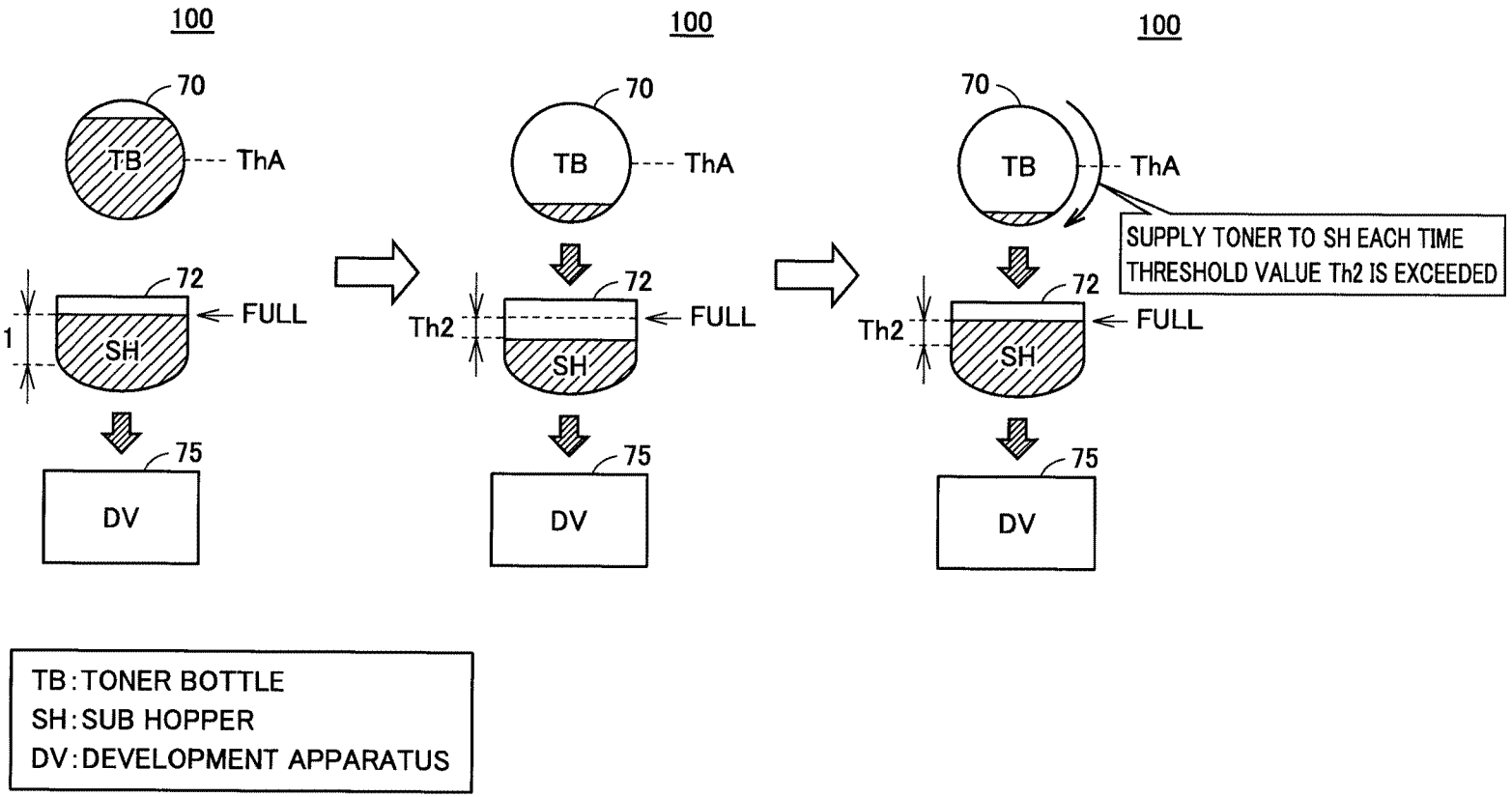
FIG. 2 is a diagram showing a process for supplying toner when a remaining amount of toner in the toner bottle is small.

A method of supplying toner in an image formation apparatus 100 according to the present embodiment will be described with reference to FIG. 1. FIG. 1 is a diagram showing a process for supplying toner when a remaining amount of toner in a toner bottle 70 is large. FIG. 2 is a diagram showing a process for supplying toner when a remaining amount of toner in toner bottle 70 is small.

As shown in FIGS. 1 and 2, image formation apparatus 100 includes toner bottle 70 which holds toner, a sub hopper 72 (a storage portion), and a development apparatus 75. Toner bottle 70 supplies toner to sub hopper 72. Sub hopper 72 temporarily stores toner supplied from toner bottle 70. Development apparatus 75 receives supply of toner from sub hopper 72 and develops a toner image in accordance with an electrostatic latent image onto a photoconductor 40 which will be described later.

Image formation apparatus 100 can detect a remaining amount of toner in toner bottle 70 with a first detector 152 (see FIG. 6) which will be described later. Image formation apparatus 100 can detect an empty space for toner in sub hopper 72 with a second detector 154 (see FIG. 6) which will be described later.

The empty space here refers to an amount of toner which can be supplied to sub hopper 72. The empty space corresponds to a value calculated by subtracting a current remaining amount of toner from an amount of toner in a full state. Since the "empty space for toner" and the "remaining amount of toner" correlate with each other, when the term "empty space for toner" is used, a concept of the "remaining amount of toner" may also be encompassed, and when the term "remaining amount of toner" is used, a concept of the "empty space for toner" may also be encompassed.

As shown in FIG. 1, when the remaining amount of toner in toner bottle 70 is equal to or greater than a threshold value ThA, image formation apparatus 100 supplies toner from toner bottle 70 to sub hopper 72 each time an empty space for toner in sub hopper 72 exceeds a threshold value Th1. As shown in FIG. 2, image formation apparatus 100 lowers threshold value Th1 to a threshold value Th2 when the remaining amount of toner in toner bottle 70 is smaller than threshold value ThA.

Thus, when the remaining amount of toner in toner bottle 70 is small, image formation apparatus 100 can increase a frequency of supply of toner from toner bottle 70 to sub hopper 72. When the remaining amount of toner in toner bottle 70 is small, replacement of toner bottle 70 is more likely. When a frequency of supply to sub hopper 72 is increased here, image formation apparatus 100 can decrease the remaining amount of toner by the time of replacement of toner bottle 70.

When the remaining amount of toner in toner bottle 70 is large, an amount of toner supplied from toner bottle 70 to sub hopper 72 at one time may be irregular and unstable. Image formation apparatus 100 increases a frequency of supply of toner after the remaining amount of toner in toner bottle 70 becomes small. Therefore, toner can be supplied to sub hopper 72 in a stable manner.

Though a method of controlling supply of toner to sub hopper 72 based on threshold values in two stages of threshold value Th1 and threshold value Th2 is described with reference to the example in FIG. 2, image formation apparatus 100 may control supply of toner to sub hopper 72 based on threshold values in three or more stages. For example, image formation apparatus 100 may lower a value for threshold value Th1 as the remaining amount of toner in toner bottle 70 is smaller. Threshold value Th1 is lowered in accordance with a remaining amount of toner in toner bottle 70. Thus, as the remaining amount of toner in toner bottle 70 is smaller, a frequency of supply of toner to sub hopper 72 is increased. Consequently, image formation apparatus 100 can more reliably decrease a remaining amount of toner by the time of replacement of toner bottle 70.

[Apparatus Configuration of Image Formation Apparatus 100]

Figure 3:
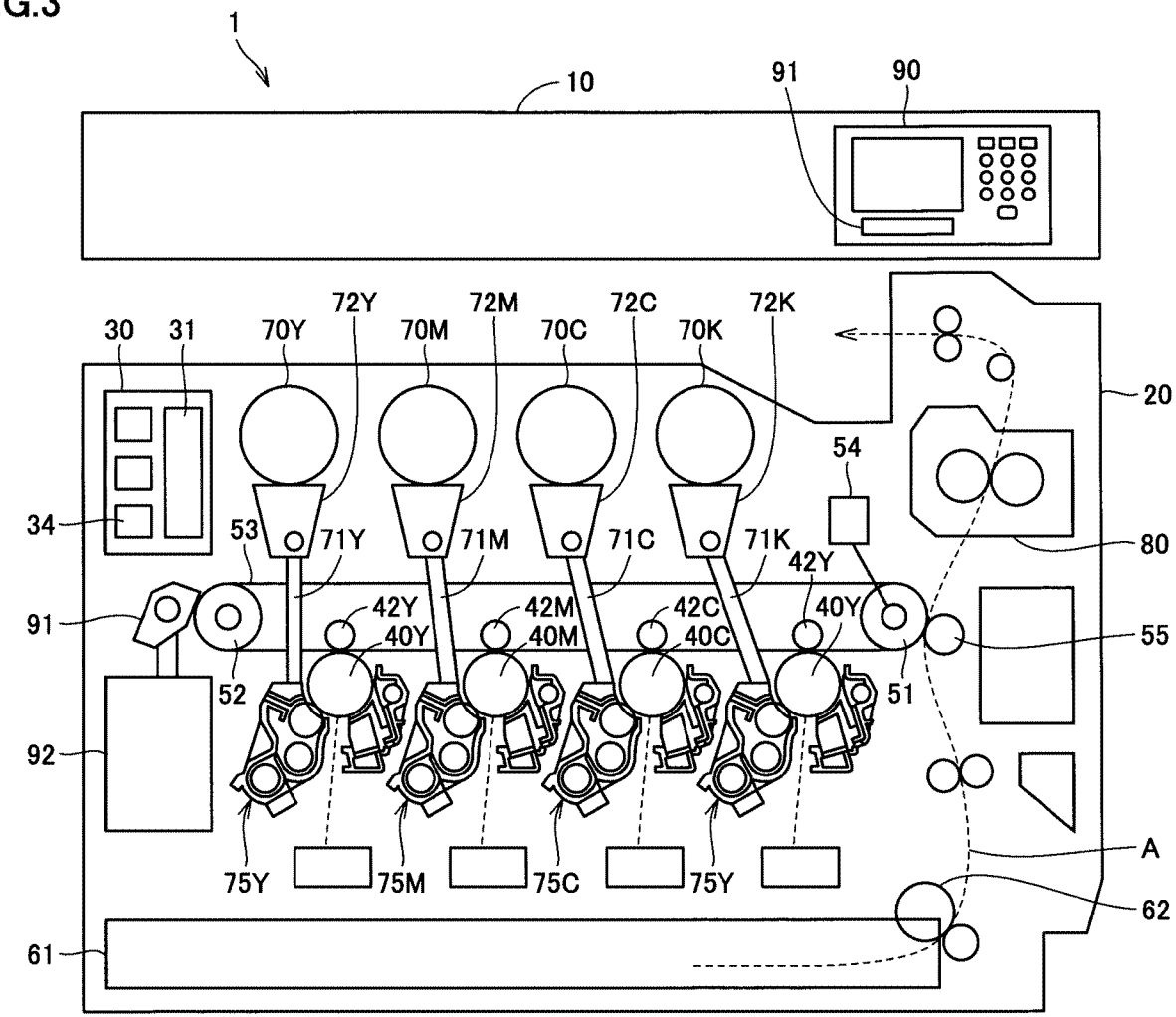
FIG. 3 is a diagram showing one example of an apparatus configuration of an image formation apparatus according to a first embodiment.
Figure 4:
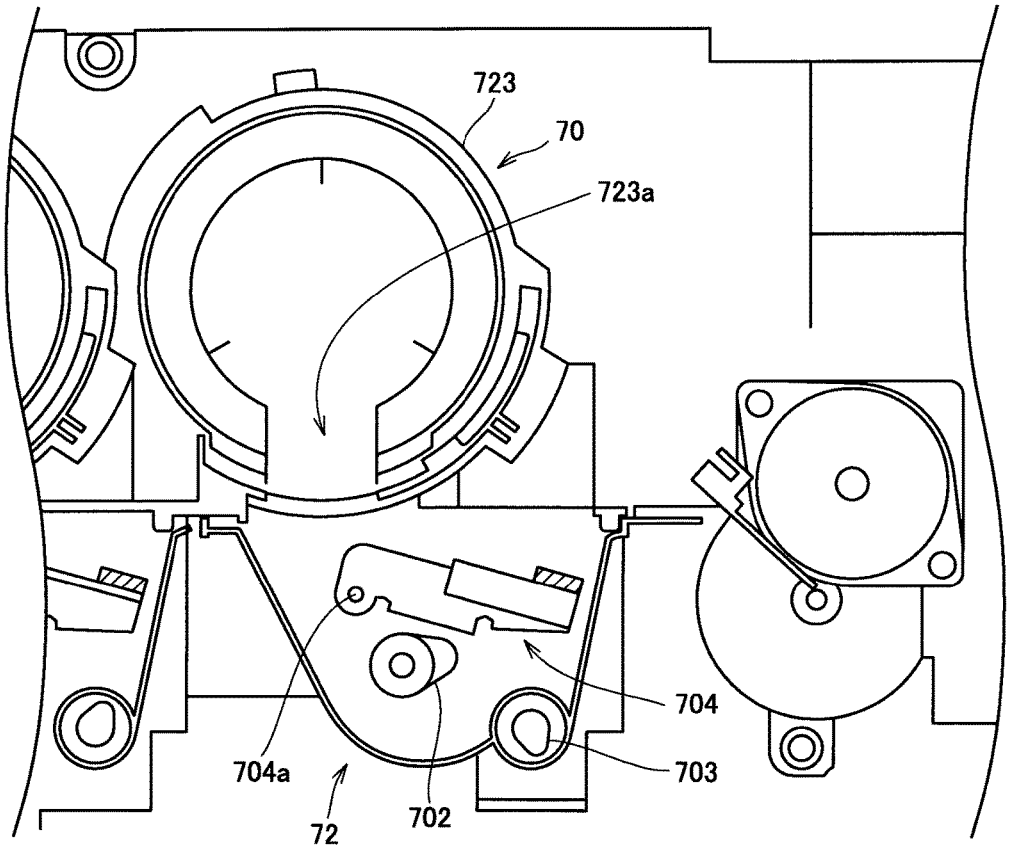
FIG. 4 is a diagram showing a cross-sectional view of a sub hopper and a toner bottle.
Figure 5:
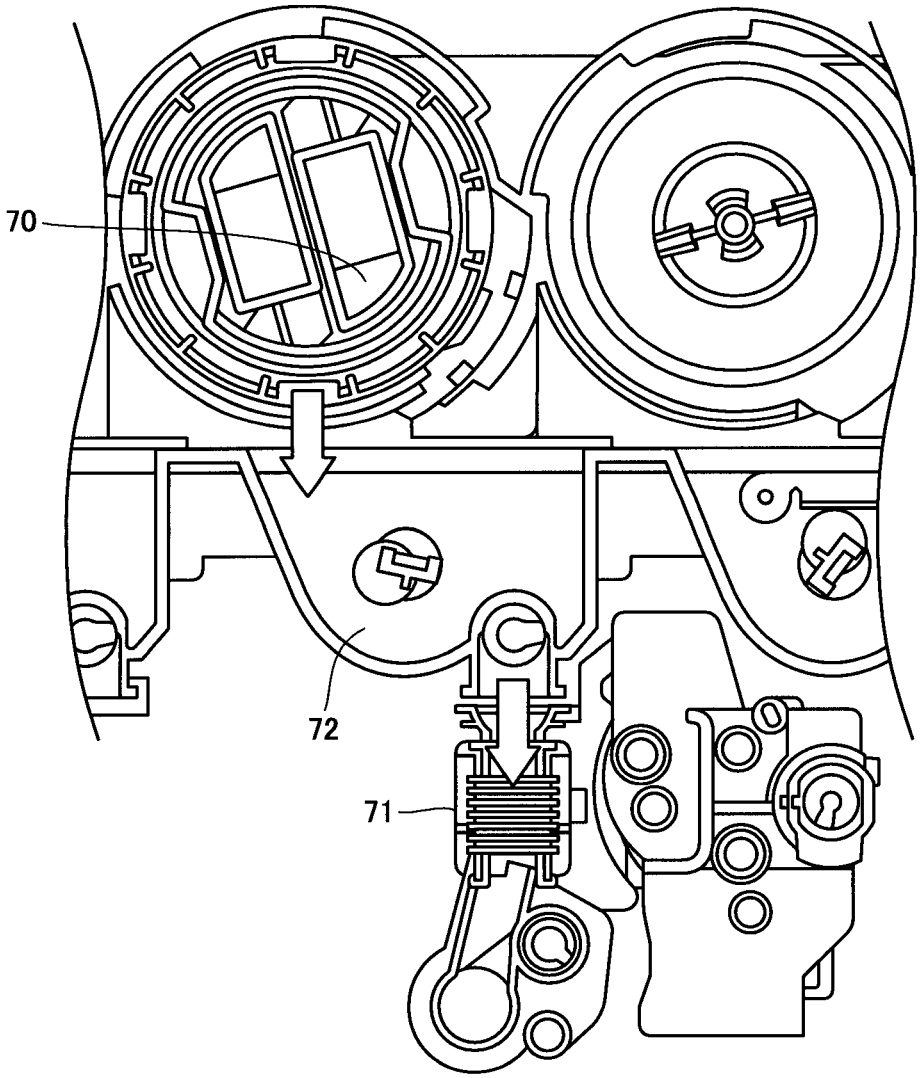
FIG. 5 is a diagram showing a replenishment mechanism further added to the apparatus configuration in FIG. 4.

An apparatus configuration of image formation apparatus 100 according to the first embodiment will be described with reference to FIGS. 3 to 5. FIG. 3 is a diagram showing one example of an apparatus configuration of image formation apparatus 100. FIG. 4 is a diagram showing a cross-sectional view of sub hopper 72 and toner bottle 70. FIG. 5 is a diagram showing a replenishment mechanism 71 further added to the apparatus configuration in FIG. 4.

FIG. 3 shows image formation apparatus 100 as a color printer. Though image formation apparatus 100 as the color printer is described below, image formation apparatus 100 is not limited to the color printer. For example, image formation apparatus 100 may be a monochrome printer or a multi-functional peripheral (MFP) of a monochrome printer, a color printer, and a FAX as being combined.

Image formation apparatus 100 includes an image reader 10 which reads an image of a document and a printer 20 which prints the read image.

Image reader 10 reads a document placed on a glass plate (not shown) by moving a scanner. An image obtained by reading the document is decomposed into three colors of red (R), green (G), and blue (B), and converted to an electric signal by a charge coupled device (CCD) image sensor (not shown). Consequently, image data of each color of R, G, and B is obtained.

The image data for each color component obtained by image reader 10 is subjected to various processing in a control device 102 and converted to image data of each reproduction color of cyan (C), magenta (M), yellow (Y), and black (K).

Each piece of image data is stored in an image memory 34 in control device 102 for each reproduction color, subjected to correction of position displacement, and thereafter read for each one scanning line in synchronization with supply of a document, so that a signal for driving a light emitting diode is output.

Documents are taken out one by one from a paper feed tray 61 by a paper feed roller 62 and sent in synchronization with an intermediate transfer belt 53 which will be described later.

Intermediate transfer belt 53 is looped over a drive roller 51 and a driven roller 52. Driven roller 52 is biased to the left in FIG. 3 by a spring (not shown), so that tensile force is applied to intermediate transfer belt 53. As a main body controller 31 drives a transfer motor 54, drive roller 51 rotates counterclockwise. Consequently, intermediate transfer belt 53 also rotates counterclockwise.

Development apparatuses 75Y, 75M, 75C, and 75K of respective colors of yellow (Y), magenta (M), cyan (C), and black (K) are arranged below intermediate transfer belt 53 at a prescribed interval. Photoconductors 40Y, 40M, 40C, and 40K are provided to face development apparatuses 75Y, 75M, 75C, and 75K, respectively. Development apparatuses 75Y, 75M, 75C, and 75K are hereinafter also collectively referred to as a development apparatus 75 (see FIG. 1). Photoconductors 40Y, 40M, 40C, and 40K are also collectively referred to as a photoconductor 40.

Transfer rollers 42Y, 42M, 42C, and 42K are arranged at respective positions opposed to photoconductor 40 of development apparatus 75. Transfer rollers 42Y, 42M, 42C, and 42K are hereinafter also collectively referred to as a transfer roller 42.

When intermediate transfer belt 53 passes between photoconductor 40 and transfer roller 42, a toner image formed on a surface of photoconductor 40 is primarily transferred onto intermediate transfer belt 53.

A document conveyed from paper feed tray 61 passes along a dashed line. A and passes through a nip portion between intermediate transfer belt 53 and a secondary transfer roller 55. Here, the toner image on intermediate transfer belt 53 is secondarily transferred to the document. Then, the document is conveyed to a fixation apparatus 80. Fixation apparatus 80 heats and pressurizes the document and fixes the toner image to the document. Thereafter, the document is ejected to the outside of the apparatus.

Toner which remains on intermediate transfer belt 53 is recovered by a transfer belt cleaner 91 and stored in a waste toner box 92.

Development apparatuses 75Y, 75M, 75C, and 75K are provided with sub hoppers 72Y, 72M, 72C, and 72K which replenish a certain amount of toner of respective colors, respectively. Sub hoppers 72Y, 72M, 72C, and 72K are also hereinafter collectively referred to as sub hopper 72 (see FIG. 1). Toner is supplied to development apparatus 75 via sub hopper 72.

Toner bottles 70Y, 70M, 70C, and 70K are removably provided above sub hoppers 72Y, 72M, 72C, and 72K, respectively. Toner bottles 70Y, 70M, 70C, and 70K are also hereinafter collectively referred to as toner bottle 70 (see FIG. 1). Toner bottle 70 holds toner and supplies toner to sub hopper 72 each time toner in sub hopper 72 decreases. When toner in toner bottle 70 runs out, toner bottle 70 is replaced with a new toner bottle 70 by a user.

Development apparatus 75 is provided with a sensor (not shown) for detecting a concentration of toner. When a concentration of toner in development apparatus 75 is lower than a prescribed value, a gear 703 of sub hopper 72 for replenishment to the development apparatus rotates forward and development apparatus 75 is replenished with toner, so that a predetermined concentration of toner is attained.

A supply port 723*a* of a cap portion 723 is located above sub hopper 72. In sub hopper 72, a float member 704 for detecting a level of an upper surface of toner is swingably provided around a shaft 704*a*. A remaining amount of toner in sub hopper 72 is detected in accordance with the level of the upper surface detected by float member 704. A cam 702 which rotates together with an agitation shaft is provided below float member 704, and float member 704 vertically swings with rotation of cam 702. Toner in sub hopper 72 is supplied to development apparatus 75 through replenishment mechanism 71.

[Functional Configuration of Image Formation Apparatus 100]

Figure 6:
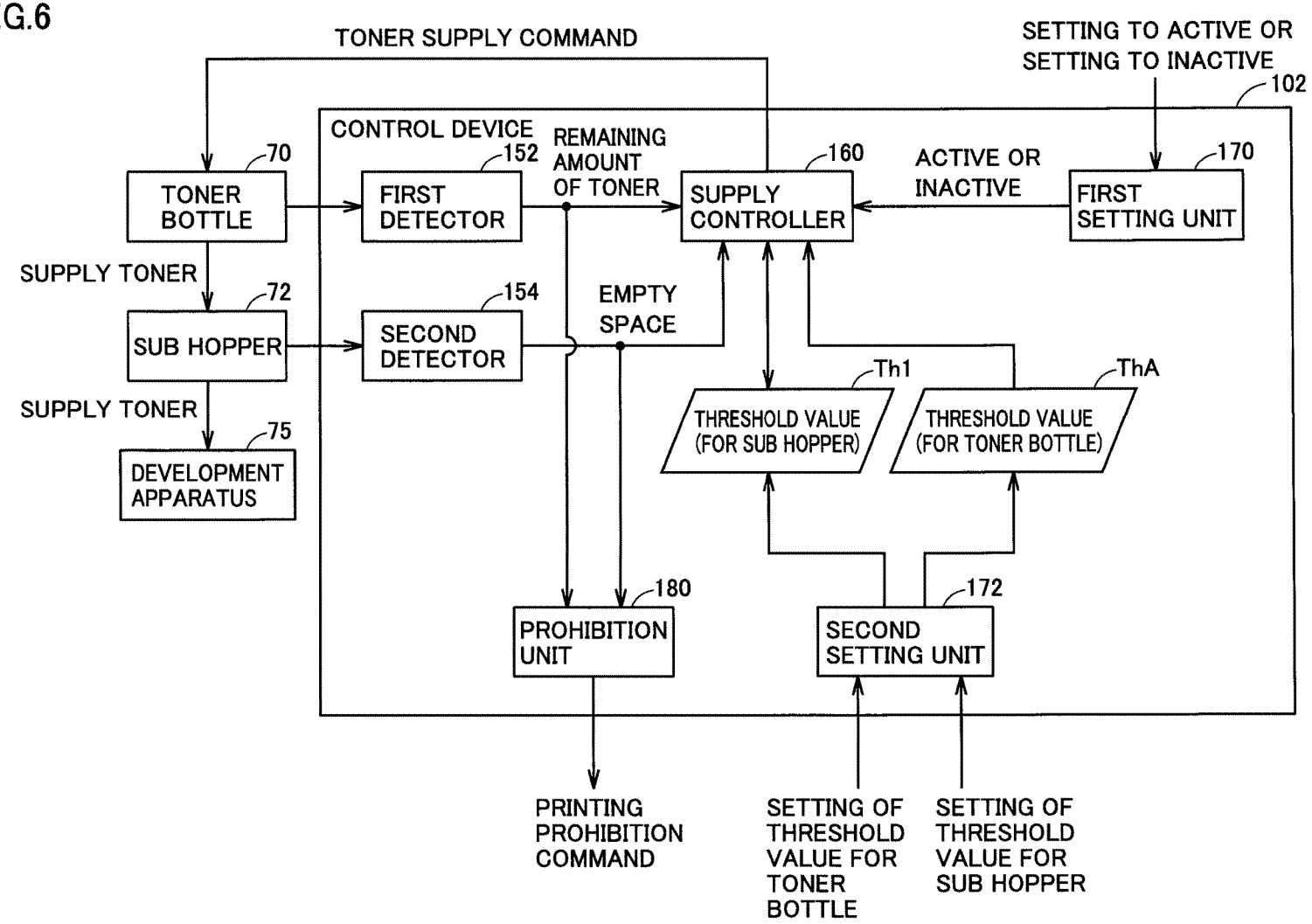
FIG. 6 is a diagram showing one example of a functional configuration of the image formation apparatus according to the first embodiment.

A function of image formation apparatus 100 according to the first embodiment will be described with reference to FIG. 6. FIG. 6 is a diagram showing one example of a functional configuration of image formation apparatus 100 according to the first embodiment.

As shown in FIG. 6, image formation apparatus 100 includes toner bottle 70, sub hopper 72, development apparatus 75, and control device 102. Control device 102 is implemented, for example, by a central processing unit (CPU), and includes as a functional configuration, first detector 152, second detector 154, a supply controller 160, a first setting unit 170, a second setting unit 172, and a prohibition unit 180. Control device 102 stores as data, a threshold value ThA for toner bottle 70 and a threshold value Th1 for sub hopper 72. Threshold value ThA and threshold value Th1 may be stored in a storage area such as a cache of control device 102 or in a storage device 120 which will be described later.

First detector 152 detects a remaining amount of toner in toner bottle 70. A method of detecting the remaining amount of toner is arbitrary. For example, first detector 152 may mechanically detect a remaining amount of toner by making use of a sensor or may detect a remaining amount of toner with software by making use of a toner amount detection program.

In one aspect, first detector 152 detects a remaining amount of toner in toner bottle 70 by making use of a sensor for detecting an amount of toner such as a magnetic sensor. In another aspect, first detector 152 detects a remaining amount of toner in accordance with the number of dots in a toner attached region in an input image. More specifically, first detector 152 counts the number of dots in the toner attached region each time print processing is performed, and calculates an amount of consumed toner in accordance with the count value. First detector 152 calculates a remaining amount of toner in toner bottle 70 by subtracting the calculated amount of consumed toner from an amount of toner at the time when toner bottle 70 is filled up with toner.

Second detector 154 detects an empty space for toner in sub hopper 72. A method of detecting the empty space is arbitrary. For example, second detector 154 may mechanically detect a remaining amount of toner by making use of a sensor or may detect a remaining amount of toner with software by making use of a toner amount detection program.

In one aspect, second detector 154 detects an empty space for toner in sub hopper 72 by making use of a sensor for detecting an amount of toner such as a magnetic sensor. More specifically, second detector 154 calculates an empty space for toner in sub hopper 72 by subtracting a remaining amount of toner in sub hopper 72 detected by the sensor from an amount of toner at the time when sub hopper 72 is filled up with toner. In another aspect, second detector 154 detects a remaining amount of toner in accordance with the number of dots in a toner attached region in an input image. More specifically, second detector 154 counts the number of dots in the toner attached region each time print processing is performed, and calculates an amount of consumed toner in accordance with the count value. The amount of consumed toner is initialized each time toner is supplied to sub hopper 72. Second detector 154 detects an amount of consumed toner as an empty space for toner in sub hopper 72.

Supply controller 160 has toner supplied from toner bottle 70 to sub hopper 72 each time the empty space for toner in sub hopper 72 exceeds threshold value ThA for toner bottle. When the remaining amount of toner in toner bottle 70 is smaller than threshold value ThA, threshold value Th1 is lowered from the current value. Thus, when toner in toner bottle 70 is small in amount, a frequency of supply of toner to sub hopper 72 is increased.

First setting unit 170 accepts setting as to whether or not to activate change in threshold value Th1 for sub hopper by supply controller 160. The setting is accepted, for example, in a setting screen on image formation apparatus 100. When change in threshold value Th1 is set to active, change in threshold value Th1 by supply controller 160 is permitted. When change in threshold value Th1 is set to inactive, change in threshold value Th1 by supply controller 160 is prohibited.

Second setting unit 172 accepts setting of at least one of threshold value ThA for toner bottle and threshold value Th1 for sub hopper. The setting is accepted, for example, in a setting screen on image formation apparatus 100. Namely, a user can arbitrarily input a value for threshold value ThA and threshold value ThA1 in the setting screen.

Prohibition unit 180 prohibits print processing by image formation apparatus 100 when the remaining amount of toner in toner bottle 70 is smaller than threshold value ThA and when the empty space for toner in sub hopper 72 exceeds threshold value Th1. When the remaining amount of toner in sub hopper 72 and toner bottle 70 is small, prohibition unit 180 stops print processing. Thus, execution of the print processing in spite of absence of toner is prevented.

[Control of Representation on Image Formation Apparatus 100]

Control of representation on image formation apparatus 100 will be described with reference to FIG. 7. FIG. 7 is a diagram showing one example of a manner of representation on image formation apparatus 100 in accordance with a remaining amount of toner in toner bottle 70 and sub hopper 72.

A display 109 (see FIG. 9) of image formation apparatus 100 changes contents of representation in accordance with a remaining amount of toner in toner bottle 70 and sub hopper 72.

As shown with a state A in FIG. 7, display 109 shows nothing when a remaining amount of toner in toner bottle 70 is equal to or greater than threshold value ThA. When a sufficient amount of toner remains in toner bottle 70, nothing is shown on display 109.

As shown with a state B in FIG. 7, display 109 shows contents for having toner bottle 70 prepared when a remaining amount of toner in toner bottle 70 is smaller than threshold value ThA. In this case, for example, a message "prepare new toner bottle" is shown on display 109. The user can thus prepare a new toner bottle before toner completely runs out. Contents for having toner bottle 70 prepared may be shown with an image instead of a message.

As shown with a state C in FIG. 7, display 109 shows contents for inviting replacement of toner bottle 70 when a remaining amount of toner in toner bottle 70 is smaller than a predetermined value smaller than threshold value ThA. The contents are shown when toner bottle 70 is empty. By way of example, the contents are shown when the remaining amount of toner being lower than the predetermined value is detected a plurality of times (for example, three times). For example, a message "time to replace toner bottle" is shown as representation contents on display 109. The user can thus know appropriate timing of replacement of toner bottle 70. Contents for having toner bottle 70 replaced may be shown with an image instead of a message.

As shown with a state D in FIG. 7, display 109 prohibits printing by image formation apparatus 100 and makes a degree of inviting replacement of toner bottle 70 higher than in state C when a remaining amount of toner in toner bottle 70 is smaller than the predetermined value smaller than threshold value ThA and when an empty space in sub hopper 72 exceeds threshold value Th1 (see FIG. 6). By way of example, when an amount of consumed toner after transition to state C exceeds a predetermined amount (for example, 10 g), image formation apparatus 100 determines that both of toner bottle 70 and sub hopper 72 are empty and transition from state C to state D is made. In this case, a message "replace toner bottle" is shown on display 109.

[Control Structure of Image Formation Apparatus 100]

Figure 8:
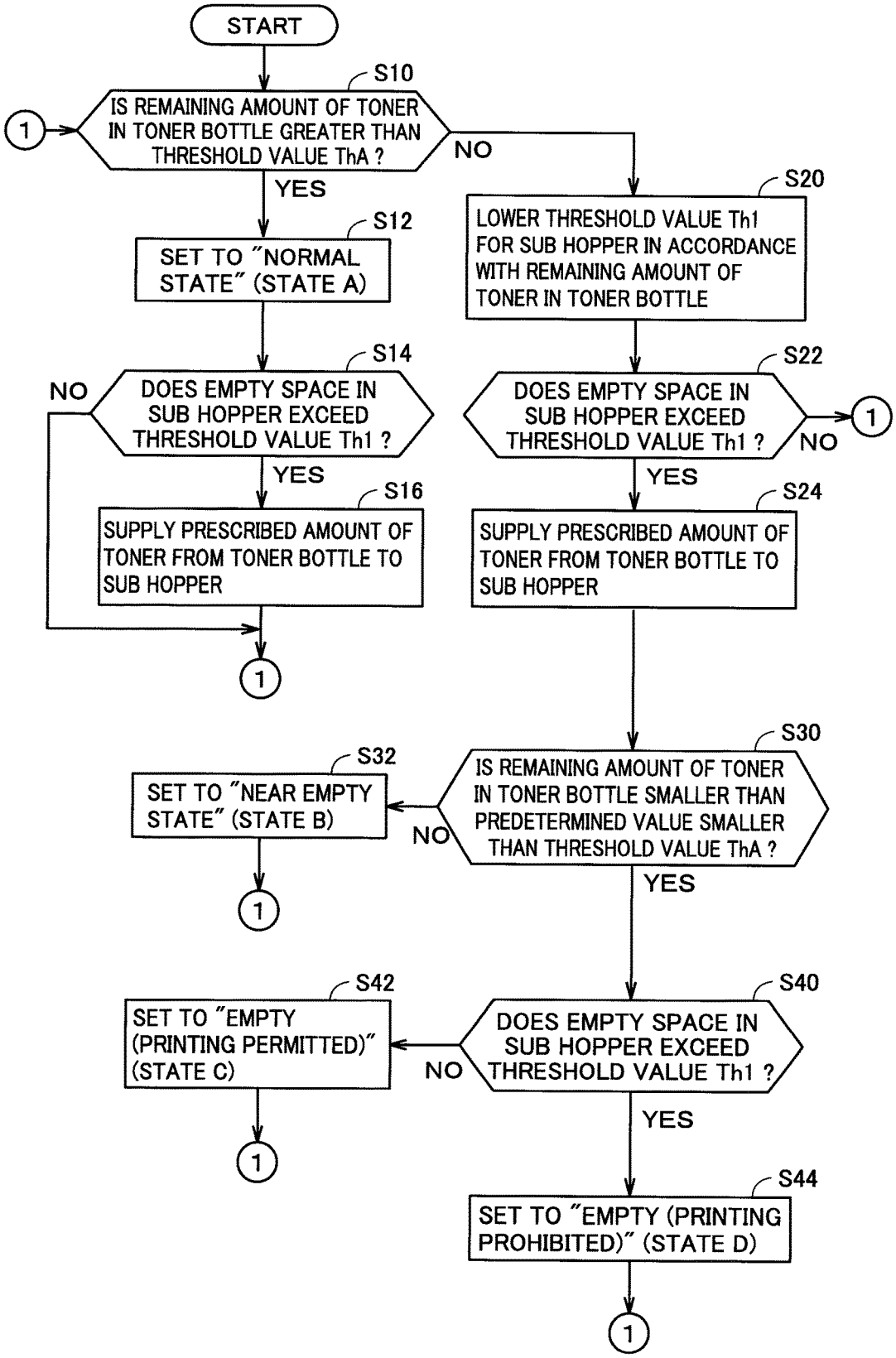
FIG. 8 is a flowchart showing a part of processing performed by the image formation apparatus according to the first embodiment.

A control structure of image formation apparatus 100 will be described with reference to FIG. 8. FIG. 8 is a flowchart showing a part of processing performed by image formation apparatus 100. A process in FIG. 8 is implemented by execution of a program by control device 102 of image formation apparatus 100. In another aspect, a part or the entirety of the process may be performed by a circuit element or other hardware.

In step S10, control device 102 as supply controller 160 (see FIG. 6) determines whether or not a remaining amount of toner in the toner bottle is larger than threshold value ThA (see FIG. 1). When control device 102 determines that a remaining amount of toner in the toner bottle is larger than threshold value ThA (YES in step S10), it switches control to step S12. Otherwise (NO in step S10), control device 102 switches control to step S20.

In step S12, control device 102 sets a state of image formation apparatus 100 to a "normal state" (state A) (see FIG. 7).

In step S14, control device 102 as supply controller 160 determines whether or not an empty space in the sub hopper exceeds threshold value Th1 (see FIG. 1). When control device 102 determines that an empty space in the sub hopper exceeds threshold value Th1 (YES in step S14), it switches control to step S16. Otherwise (NO in step S14), control device 102 returns control to step S10.

In step S16, control device 102 as supply controller 160 has a predetermined amount (for example, 10 g) of toner supplied from the toner bottle to the sub hopper. Typically, toner in an amount corresponding to the empty space in the sub hopper is supplied so that the sub hopper is filled up.

In step S20, control device 102 as supply controller 160 lowers threshold value Th1 for sub hopper in accordance with the remaining amount of toner in the toner bottle. By way of example, control device 102 lowers threshold value Th1 as the remaining amount of toner in the toner bottle is smaller.

In step S22, control device 102 as supply controller 160 determines whether or not an empty space in the sub hopper exceeds threshold value Th1. When control device 102 determines that the empty space in the sub hopper exceeds threshold value Th1 (YES in step S22), it switches control to step S24. Otherwise (NO in step S22), control device 102 returns control to step S10.

In step S24, control device 102 as supply controller 160 has a predetermined amount (for example, 5 g) of toner supplied from the toner bottle to the sub hopper. Typically, toner in an amount corresponding to the empty space in the sub hopper is supplied. An amount of supply of toner in step S24 is smaller than an amount of supply of toner in step S16.

In step S30, control device 102 as supply controller 160 determines whether or not a remaining amount of toner in the toner bottle is smaller than a predetermined value smaller than threshold value ThA. Control device 102 determines whether or not the toner bottle is empty. When control device 102 determines that a remaining amount of toner in the toner bottle is smaller than the predetermined amount (YES in step S30), it switches control to step S40. Otherwise (NO in step S30), control device 102 switches control to step S32.

In step S32, control device 102 sets a state of image formation apparatus 100 to a "near empty state" (state B) (see FIG. 7). Thereafter, control device 102 has display 109 (see FIG. 9) of image formation apparatus 100 show contents for having a user prepare a new toner bottle.

In step S40, control device 102 as supply controller 160 determines whether or not an empty space in the sub hopper exceeds threshold value Th1. When control device 102 determines that an empty space in the sub hopper exceeds threshold value Th1 (YES in step S40), it switches control to step S44. Otherwise (NO in step S40), control device 102 switches control to step S42.

In step S42, control device 102 sets a state of image formation apparatus 100 to an "empty state (printing permitted)" (state C) (see FIG. 7). Thereafter, control device 102 has display 109 of image formation apparatus 100 show contents for replacement with a new toner bottle.

In step S44, control device 102 as prohibition unit 180 (see FIG. 6) sets a state of image formation apparatus 100 to an "empty state (printing prohibited)" (state D) (see FIG. 7). In state D, control device 102 does not accept a print instruction. Control device 102 has display 109 of image formation apparatus 100 show contents for replacement with a new toner bottle.

When a toner bottle is replaced, control device 102 returns threshold value Th1 to a value before change and resumes the process from step S10.

[Hardware Configuration of Image Formation Apparatus 100]

Figure 9:
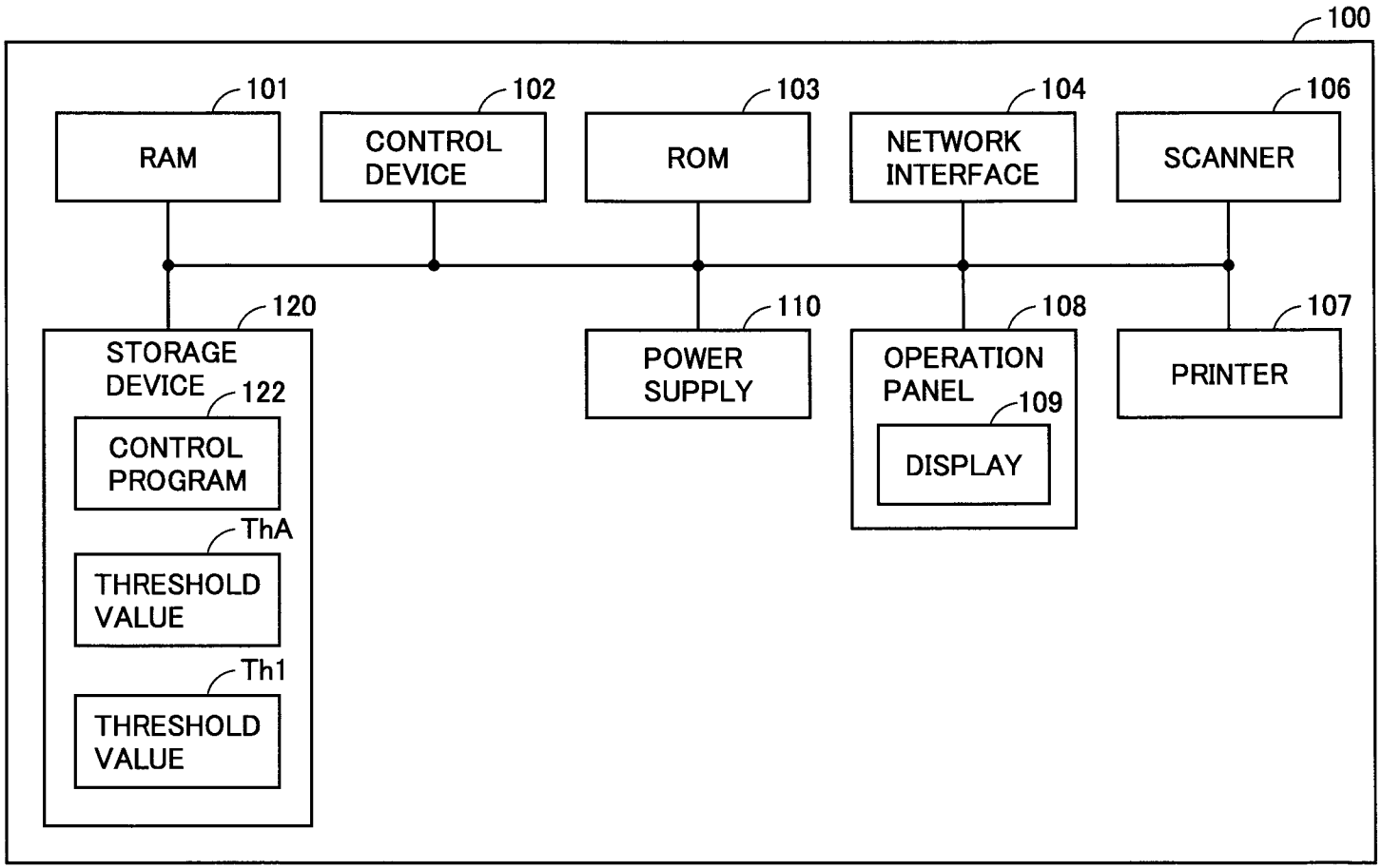
FIG. 9 is a block diagram showing a main hardware configuration of the image formation apparatus according to the first embodiment.

One example of a hardware configuration of image formation apparatus 100 will be described with reference to FIG. 9. FIG. 9 is a block diagram showing a main hardware configuration of image formation apparatus 100. As shown in FIG. 9, image formation apparatus 100 includes a read only memory (ROM) 101, control device 102, a random access memory (RAM) 103, a network interface 104, a scanner 106, a printer 107, an operation panel 108, a power supply 110, and storage device 120.

ROM 101 stores a control program executed in image formation apparatus 100. Control device 102 is implemented, for example, by a CPU. Control device 102 controls operations of image formation apparatus 100 by executing various programs such as a program for controlling image formation apparatus 100. RAM 103 functions as a working memory and temporarily stores various types of data necessary for execution of a control program.

An antenna or the like is connected to network interface 104 (a communication unit). Image formation apparatus 100 exchanges data with other communication equipment through the antenna. Other communication equipment includes, for example, a portable communication terminal such as a smartphone, a server 200 which will be described later (see FIG. 11), and other image formation apparatuses. Image formation apparatus 100 may be configured to be able to download a control program 122 according to the present embodiment from server 200 through the antenna.

Scanner 106 optically reads a document set on image formation apparatus 100 and generates image data of the document.

Printer 107 is, for example, an apparatus for converting image data read by scanner 106 with electrophotography or print data transmitted from other communication equipment into data for printing and printing an image of a document based on resultant data.

Operation panel 108 is implemented as a touch panel (not shown) and accepts a touch operation onto image formation apparatus 100. By way of example, operation panel 108 is configured with display 109 and a touch sensor provided as being layered on display 109. Operation panel 108 accepts, for example, a setting operation in connection with control program 122 or a print instruction.

Power supply 110 supplies electric power to various devices in image formation apparatus 100 based on pressing of a power button (not shown) in image formation apparatus 100.

Storage device 120 is, for example, a storage medium such as a hard disk or an external storage device. Storage device 120 stores control program 122 for implementing a process according to the present embodiment, threshold value ThA for toner bottle, and threshold value Th1 for sub hopper by way of example.

Control program 122 according to the present embodiment may be provided not as a program alone but as being incorporated as a part of any program. In this case, the process according to the present embodiment is implemented in cooperation with any program. Even a program not including some modules as such does not depart from the gist of the program according to the present embodiment. Some or all of functions provided by control program 122 according to the present embodiment may be implemented by dedicated hardware. Image formation apparatus 100 may be configured in such a form as what is called a cloud service in which at least one server implements the process according to the present embodiment.

[Result of Comparison]

Figure 10:
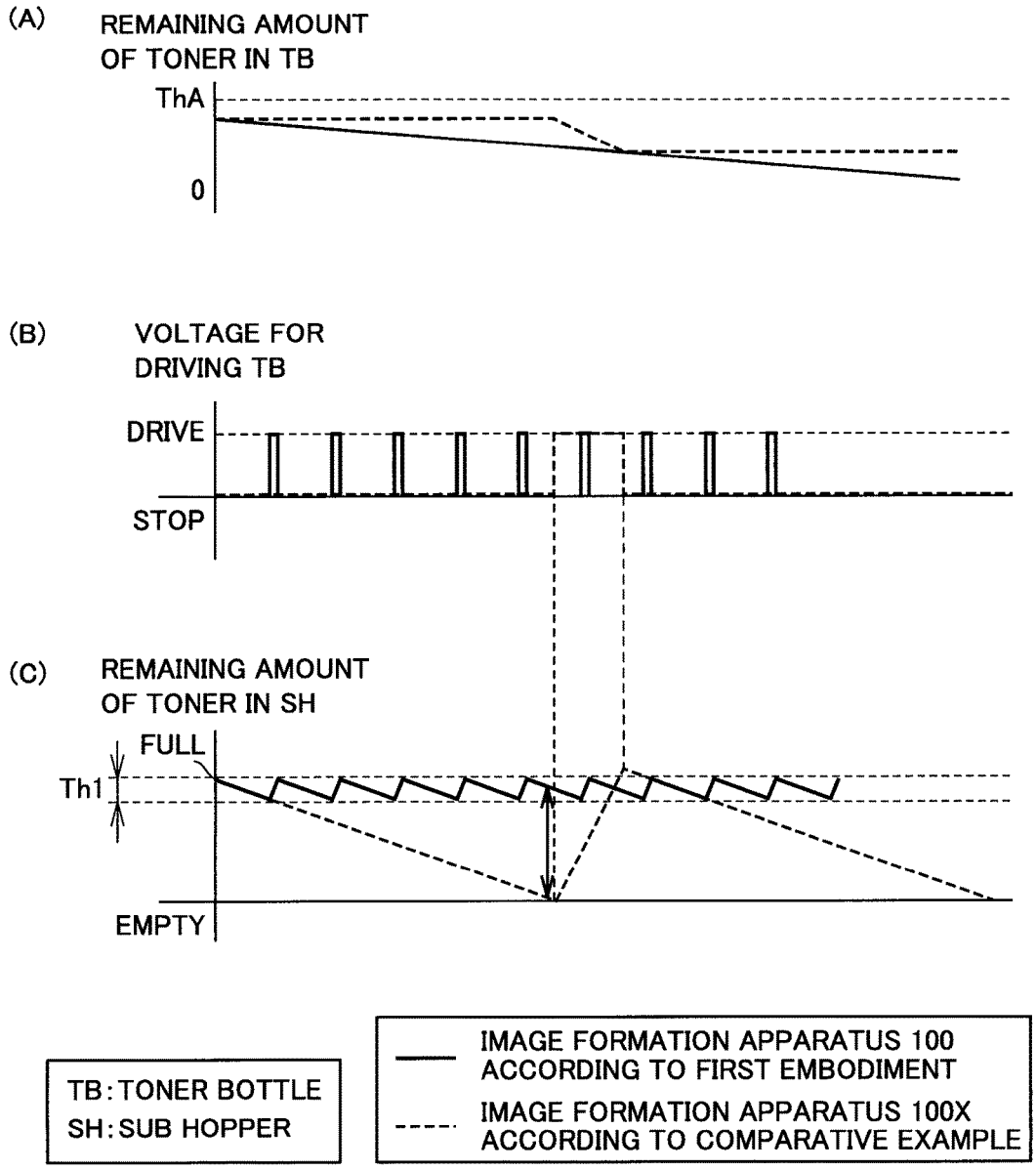
FIG. 10 is a diagram showing change in remaining amount of toner in the sub hopper in the image formation apparatus according to the first embodiment and an image formation apparatus according to a comparative example.

An advantage of image formation apparatus 100 according to the first embodiment will be described with reference to FIG. 10. FIG. 10 is a diagram showing change in remaining amount of toner in the sub hopper in image formation apparatus 100 according to the first embodiment and an image formation apparatus 100X according to a comparative example.

More specifically, a graph (A) shows transition of a remaining amount of toner in the toner bottle. A graph (B) shows timing of supply of toner from the toner bottle to the sub hopper. A graph (C) shows transition of a remaining amount of toner in the sub hopper.

As shown in graphs (A) to (C), when an amount of toner in the toner bottle is smaller than threshold value ThA, image formation apparatus 100 supplies toner from the toner bottle to the sub hopper each time an empty space in the sub hopper exceeds threshold value Th1. Image formation apparatus 100X supplies toner from the toner bottle to the sub hopper each time the sub hopper is empty. Consequently, a frequency of supply of toner to the sub hopper in image formation apparatus 100 is higher than that in image formation apparatus 100X.

Thus, when time to replace a toner bottle is near, image formation apparatus 100 frequently supplies toner from the toner bottle to the sub hopper. Thus, as shown in graph (A), a remaining amount of toner in the toner bottle in image formation apparatus 100 is always smaller than a remaining amount of toner in the toner bottle in image formation apparatus 100X. As above, image formation apparatus 100 can achieve decrease in remaining toner by the time of replacement of the toner bottle.

Second Embodiment

[Overview]

Figure 11:
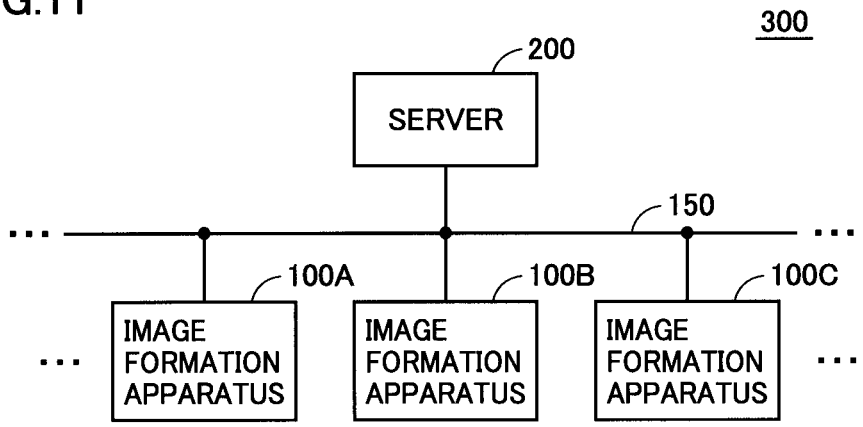
FIG. 11 is a diagram showing one example of a system configuration of an image formation system according to a second embodiment.

Image formation apparatus 100 alone is described in the first embodiment. In a second embodiment, an image formation system 300 will be described. FIG. 11 is a diagram showing one example of a system configuration of image formation system 300.

As shown in FIG. 11, image formation system 300 includes image formation apparatuses 100A to 100C and server 200. Image formation apparatuses 100A to 100C are connected to server 200 through a network 150. Image formation apparatuses 100A to 100C communicate with server 200, for example, through network interface 104 (see FIG. 9). Image formation apparatuses 100A to 100C are also hereinafter collectively referred to as image formation apparatus 100.

Image formation apparatus 100 transmits a request for ordering a new toner bottle (hereinafter also referred to as an "ordering request") to server 200 when a remaining amount of toner in the toner bottle is smaller than threshold value ThA (see FIG. 1). When toner in the toner bottle decreases, a new toner bottle is ordered. As a toner bottle is thus automatically ordered, a user can save efforts for ordering a toner bottle.

Ordering of a toner bottle means that time to replace a toner bottle is near. Therefore, image formation apparatus 100 lowers threshold value ThA for sub hopper (see FIG. 1) from the current value based on transmission of the ordering request to server 200. Image formation apparatus 100 can thus increase a frequency of supply of toner from the toner bottle to the sub hopper and decrease a remaining amount of toner by the time of replacement of a toner bottle.

[Processing for Ordering Toner Bottle]

Figure 12:
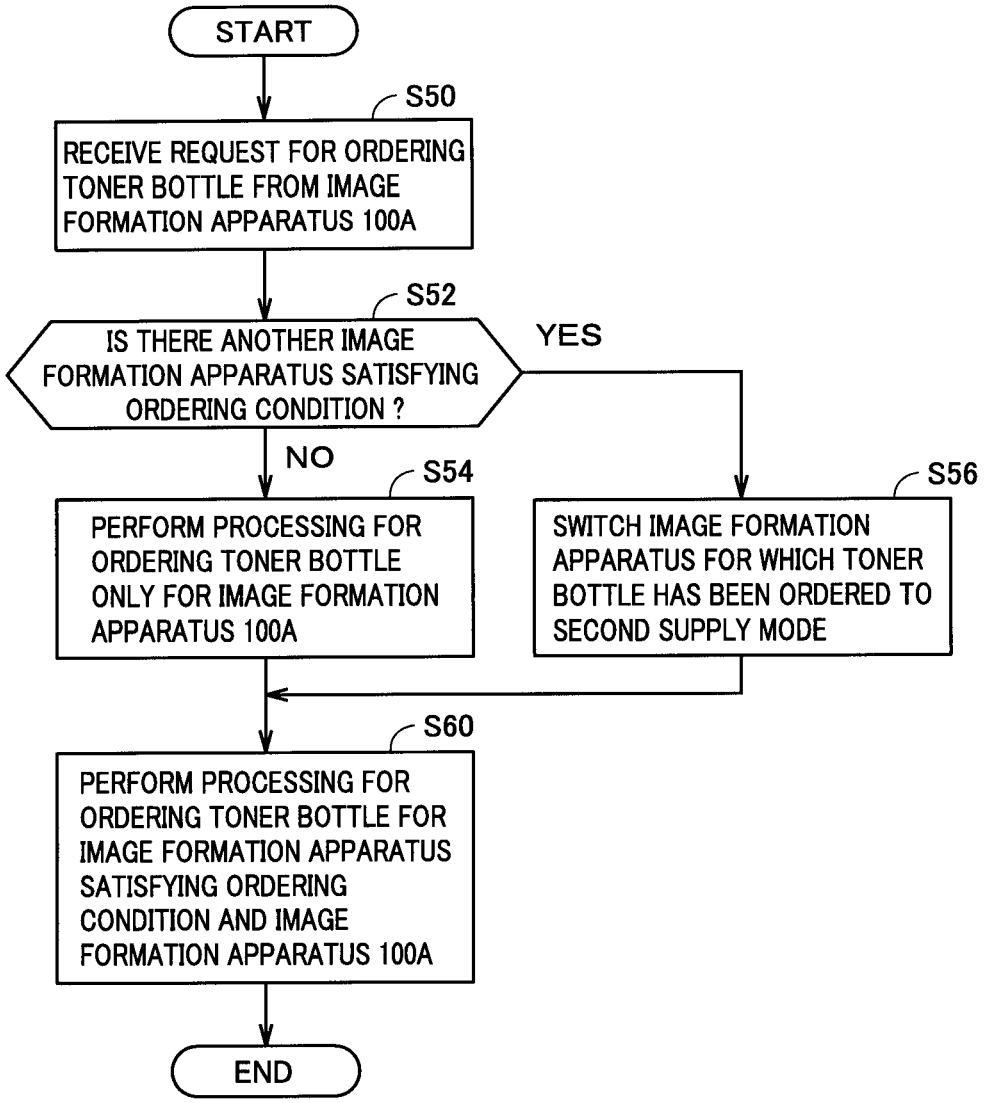
FIG. 12 is a flowchart showing processing for ordering a toner bottle by the server.

A control structure of image formation system 300 will be described with reference to FIG. 12. FIG. 12 is a flowchart showing processing for ordering a toner bottle by server 200. A process in FIG. 12 is implemented by execution of a program by a control device (for example, a CPU) of server 200. In another aspect, a pan or the entirety of the process may be performed by a circuit element or other hardware.

In step S50, server 200 receives a request for ordering a toner bottle (that is, an ordering request) from image formation apparatus 100A.

In step S52, server 200 determines whether or not there is another image formation apparatus which satisfies an ordering condition. The ordering condition is satisfied, for example, when a remaining amount of toner in the toner bottle is smaller than a prescribed amount. Server 200 searches for an image formation apparatus which satisfies the ordering condition among image formation apparatuses managed by image formation system 300. When server 200 determines that there is another image formation apparatus which satisfies the ordering condition (YES in step S52), it switches control to step S56. Otherwise (NO in step S52), server 200 switches control to step S54.

Search for an image formation apparatus which satisfies the ordering condition in step S52 can be carried out as follows. Server 200 can receive information on another image formation apparatus 100 in response to an ordering request from image formation apparatus 100A and can conduct a search based on the received information. Server 200 may periodically receive information from each image formation apparatus 100 and conduct a search based on already received information on another image formation apparatus 100 in response to an ordering request from image formation apparatus 100A.

In step S54, server 200 performs processing for ordering a toner bottle only for image formation apparatus 100A.

In step S56, server 200 performs processing for ordering a toner bottle for image formation apparatus 100A and processing for ordering a toner bottle for another image formation apparatus which satisfies the ordering condition. Thus, processing for ordering a toner bottle also for another image formation apparatus in addition to image formation apparatus 100A can be performed. Consequently, a user of each image formation apparatus can save efforts for ordering a toner bottle.

In step S60, server 200 transmits an instruction to switch from a first supply mode to a second supply mode to an image formation apparatus for which the server has performed processing for ordering a toner bottle, and image formation apparatus 100 which has received the instruction switches to the second supply mode. The "first supply mode" here refers to an operation mode in which a frequency of supply of toner from the toner bottle to the sub hopper is not increased without changing threshold value Th1 (see FIG. 1) for sub hopper. The "second supply mode" refers to an operation mode in which a frequency of supply of toner from the toner bottle to the sub hopper is increased with threshold value Th1 for sub hopper being made smaller than in a normal condition.

[Data Flow in Image Formation System 300]

Figure 13:
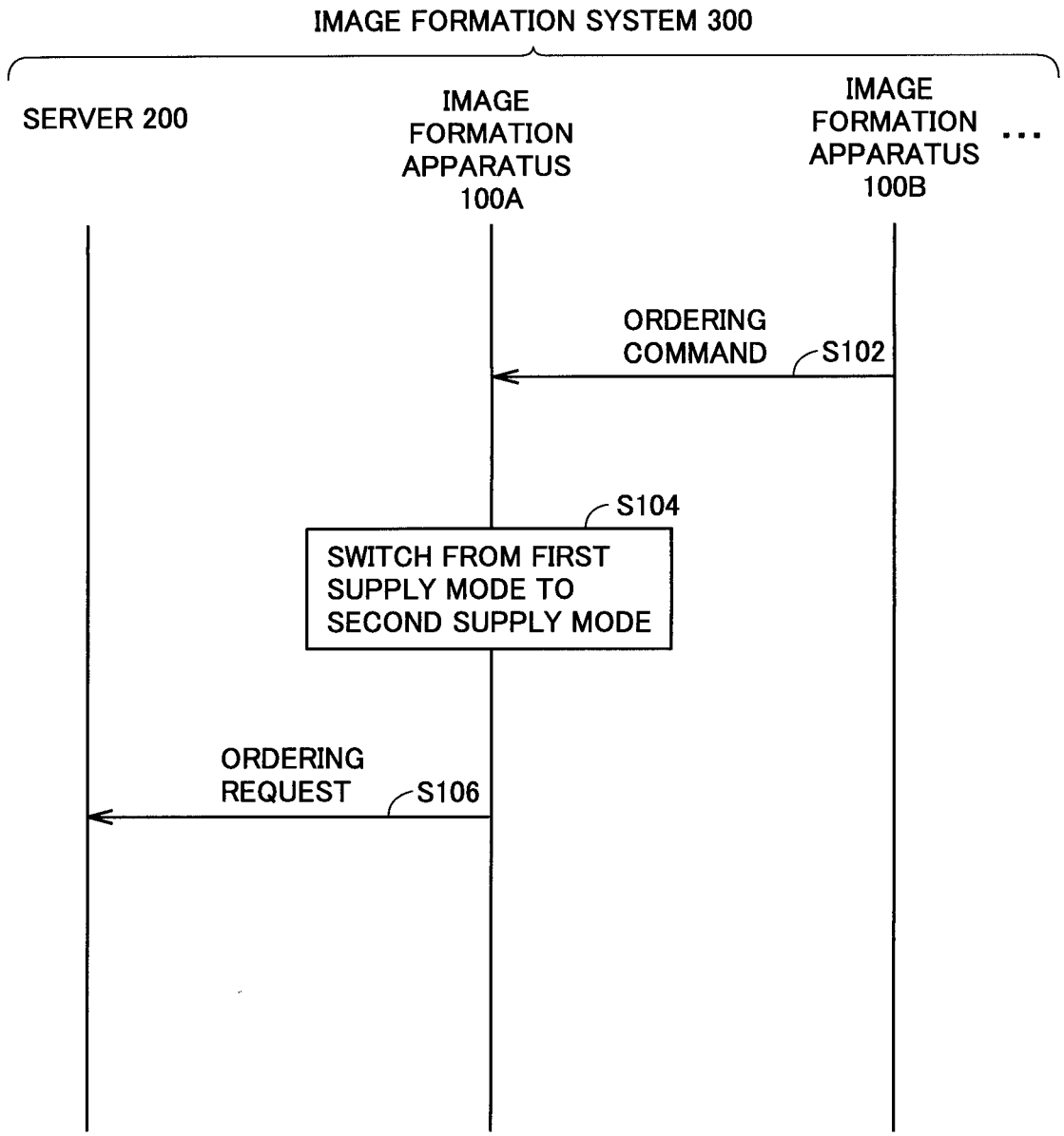
FIG. 13 is a sequence diagram showing a flow of data between the image formation apparatus and the server.

A flow of data in image formation system 300 will be described with reference to FIG. 13. FIG. 13 is a sequence diagram showing a flow of data between image formation apparatuses 100A and 100 and server 200.

Image formation apparatus 100A can receive a command for having image formation apparatus 100 order a toner bottle (hereinafter also referred to as an "ordering command") from another image formation apparatus 100B or also from server 200. By way of example, an ordering command is issued to another image formation apparatus when each image formation apparatus orders a toner bottle for itself to server 200. In step S102, image formation apparatus 100A receives an ordering command from image formation apparatus 100B.

In step S104, image formation apparatus 100A switches an operation mode from the first supply mode to the second supply mode based on reception of the ordering command from image formation apparatus 100B. Image formation apparatus 100A lowers threshold value ThA (see FIG. 1) for sub hopper from the current value based on reception of the ordering command from image formation apparatus 100B. A frequency of supply from the toner bottle to the sub hopper is thus increased.

In step S106, image formation apparatus 100A transmits a request for ordering a toner bottle to server 200.

Though an example in which image formation apparatus 100A switches the operation mode from the first supply mode to the second supply mode based on an ordering command from image formation apparatus 100B is described with reference to the example in FIG. 13, image formation apparatus 100 may switch the operation mode from the first supply mode to the second supply mode based on an ordering command from server 200.

[Summary]

As set forth above, image formation apparatus 100 according to the second embodiment increases a frequency of supply of toner from the toner bottle to the sub hopper when it transmits a request for replacing a toner bottle to the server or when it receives a command to replace a toner bottle from another image formation apparatus. As a frequency of supply of toner is increased at the time of ordering of a toner bottle, a remaining amount of toner can be decreased by the time of replacement of a toner bottle.

Third Embodiment

[Overview]

Image formation apparatus 100 according to the first embodiment increases a frequency of supply of toner to the sub hopper when a remaining amount of toner in the toner bottle decreases. In contrast, image formation apparatus 100 according to a third embodiment estimates next timing of replacement of a toner bottle and increases a frequency of supply of toner from the toner bottle to the sub hopper as the estimated next timing of replacement is nearer.

[Functional Configuration of Image Formation Apparatus 100]

Figure 14:
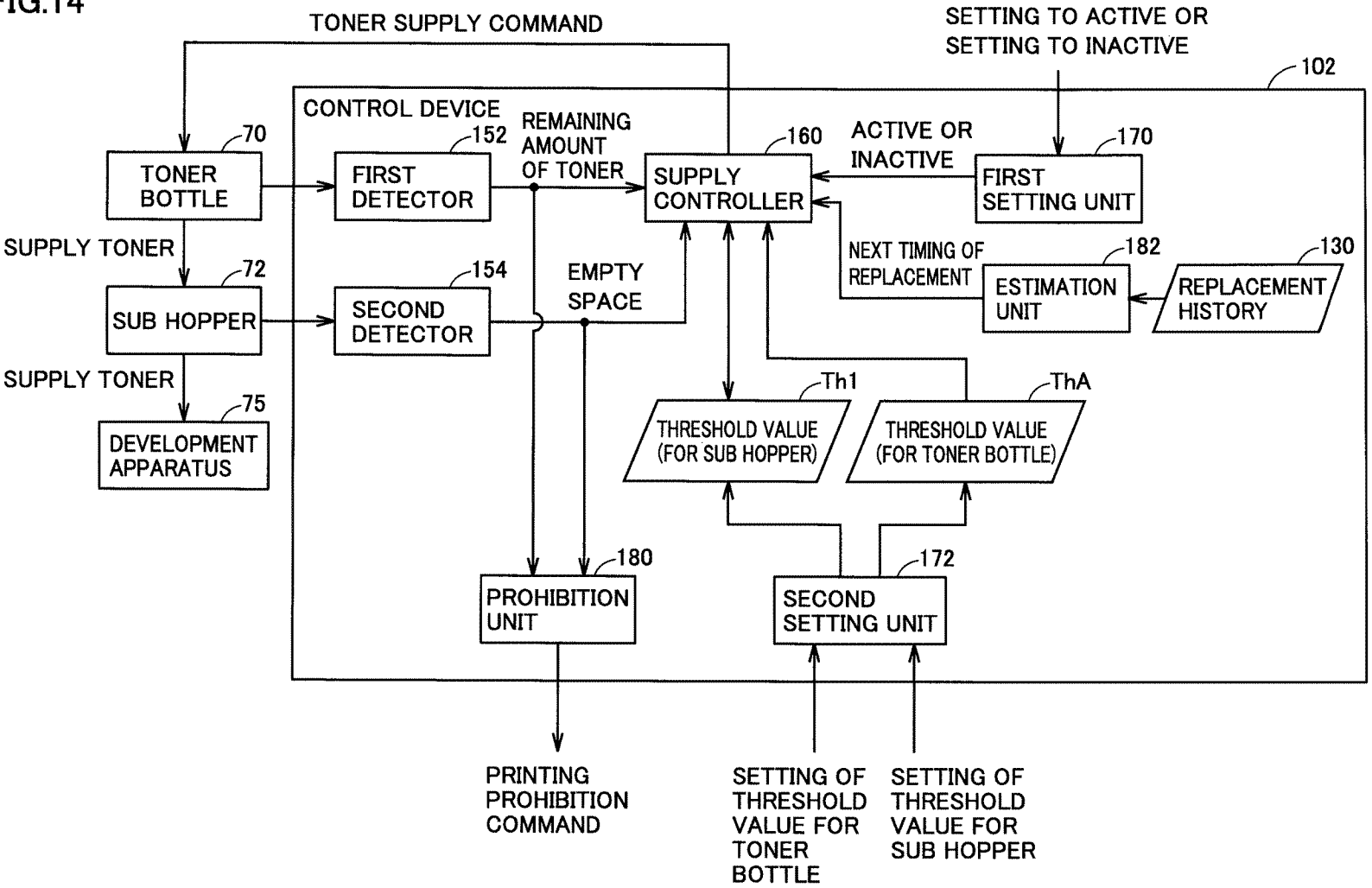
FIG. 14 is a diagram showing one example of a functional configuration of the image formation apparatus according to a third embodiment.

Processing for estimating timing to replace a toner bottle will be described with reference to FIGS. 14 and 15. FIG. 14 is a diagram showing one example of a functional configuration of image formation apparatus 100 according to the third embodiment. FIG. 15 is a diagram showing contents in a history 130 of replacement of a toner bottle.

As shown in FIG. 14, image formation apparatus 100 includes toner bottle 70, sub hopper 72, development apparatus 75, and control device 102. Control device 102 is implemented, for example, by a CPU. Control device 102 includes, as a functional configuration, first detector 152, second detector 154, supply controller 160, first setting unit 170, second setting unit 172, prohibition unit 180, and an estimation unit 182. Control device 102 stores as data, threshold value ThA for toner bottle, threshold value Th1 for sub hopper, and replacement history 130. Since the configuration other than estimation unit 182 and replacement history 130 are as described with reference to FIG. 6, description of the configuration will not be repeated.

Estimation unit 182 estimates next timing to replace a toner bottle based on replacement history 130. FIG. 15 shows contents in replacement history 130. By way of example, timing to replace a toner bottle (for example, date or time) is written in replacement history 130 for each type of toner bottle. Image formation apparatus 100 writes a type of a toner bottle and timing of replacement of the toner bottle in replacement history 130 based on replacement of the toner bottle. Replacement history 130 may be stored in a storage area such as a cache of control device 102 or in storage device 120 (see FIG. 9).

Estimation unit 182 estimates next timing of replacement of a toner bottle based on periodicity of timing of replacement of a toner bottle defined in replacement history 130. For example, estimation unit 182 calculates an interval between timings of replacement by referring to replacement history 130, averages the intervals between the timings of replacement for each type of the toner bottle, and calculates a period of replacement of each toner bottle. Estimation unit 182 determines a result of addition of a period of replacement of each toner bottle to previous timing of replacement of each toner bottle as estimated next timing of replacement of each toner bottle. Estimation unit 182 determines earliest timing among next timings of replacement of each toner bottle as estimated next timing of replacement.

Supply controller 160 lowers threshold value Th1 for sub hopper as the current time is closer to estimated next timing of replacement.

[Summary]

As set forth above, image formation apparatus 100 according to the present embodiment increases a frequency of supply of toner to the sub hopper as the current time is closer to estimated next timing of replacement. Thus, image formation apparatus 100 can further decrease a remaining amount of toner by the time of replacement of a toner bottle.

Though the embodiments of the present invention have been described, it should be understood that the embodiments disclosed herein are illustrative and non-restrictive in every respect. The scope of the present invention is defined by the terms of the claims and is intended to include any modifications within the scope and meaning equivalent to the terms of the claims.

What is claimed is:

1. An image formation apparatus comprising:

a toner bottle;

a storage portion configured to temporarily store toner supplied from the toner bottle;

a development portion configured to receive supply of toner from the storage portion;

a first detector configured to detect a remaining amount of toner in the toner bottle;

a second detector configured to detect an empty space for toner in the storage portion; and a controller configured to have toner supplied from the toner bottle to the storage portion each time the empty space exceeds a prescribed threshold value, the controller being configured to lower the prescribed threshold value from a current value when a remaining amount of toner in the toner bottle is smaller than a prescribed amount.

2. The image formation apparatus according to claim 1, wherein the controller is configured to lower the prescribed threshold value as the remaining amount of toner in the toner bottle is smaller.

3. The image formation apparatus according to claim 1, the image formation apparatus further comprising a display, wherein the display is configured to show contents for having a new toner bottle prepared when the remaining amount of toner is smaller than the prescribed amount.

4. The image formation apparatus according to claim 3, wherein the display is configured to show contents for inviting replacement of the toner bottle when the remaining amount of toner is smaller than a predetermined amount smaller than the prescribed amount.

5. The image formation apparatus according to claim 4, the image formation apparatus further comprising a prohibition unit configured to prohibit printing by the image formation apparatus when the remaining amount of toner is smaller than the predetermined amount and when the empty space exceeds the prescribed threshold value.

6. The image formation apparatus according to claim 1, the image formation apparatus further comprising a setting unit configured to accept whether to activate change in the prescribed threshold value by the controller.

7. The image formation apparatus according to claim 1, the image formation apparatus further comprising a setting unit configured to accept setting of the prescribed threshold value.

8. The image formation apparatus according to claim 1, the image formation apparatus further comprising a communication unit configured to transmit a request for ordering a new toner bottle to a server when the remaining amount of toner is smaller than the prescribed amount.

9. The image formation apparatus according to claim 8, wherein the communication unit can receive a command for transmitting the request to the server from another image formation apparatus or the server, and the controller is configured to lower the prescribed threshold value from the current value based on reception of the command.

10. The image formation apparatus according to claim 8, wherein the controller is configured to lower the prescribed threshold value from the current value based on transmission of the request to the server.

11. The image formation apparatus according to claim 1, the image formation apparatus further comprising:

a storage unit configured to hold a history of replacement of the toner bottle; and an estimation unit configured to estimate next timing of replacement of the toner bottle based on the history of replacement, wherein the controller is configured to lower the prescribed threshold value as the next timing of replacement is nearer.

12. An image formation system comprising:

a plurality of image formation apparatuses; and a server configured to communicate with the plurality of image formation apparatuses, each of the image formation apparatuses including a toner bottle, a storage portion configured to temporarily store toner supplied from the toner bottle, a development portion configured to receive supply of toner from the storage portion, a first detector configured to detect a remaining amount of toner in the toner bottle, a second detector configured to detect an empty space for toner in the storage portion, a first controller configured to have toner supplied from the toner bottle to the storage portion each time the empty space exceeds a prescribed threshold value, and a communication unit configured to transmit a request for ordering a new toner bottle to the server when a remaining amount of toner in the toner bottle is smaller than a prescribed amount, the server including a second controller configured to perform, in response to reception of the request from one image formation apparatus among the plurality of image formation apparatuses, processing for ordering a new toner bottle for another image formation apparatus which satisfies a prescribed ordering condition among the plurality of image formation apparatuses and the one image formation apparatus and to give a mode switching instruction to instruct the image formation apparatuses for which the server has performed the ordering processing to switch to a mode for lowering the prescribed threshold value, each first controller being configured to lower the prescribed threshold value from a current value in response to the mode switching instruction from the server.

13. A method of controlling an image formation apparatus configured to communicate with a server, the image formation apparatus including a toner bottle, a storage portion configured to temporarily store toner supplied from the toner bottle, and a development portion configured to receive supply of toner from the storage portion, the method comprising:

detecting a remaining amount of toner in the toner bottle;

detecting an empty space for toner in the storage portion;

supplying toner from the toner bottle to the storage portion each time the empty space exceeds a prescribed threshold value;

the image formation apparatus transmitting a request for ordering a new toner bottle to the server when a remaining amount of toner in the toner bottle is smaller than a prescribed amount;

the server searching for another image formation apparatus which satisfies a prescribed ordering condition among a plurality of image formation apparatuses, in response to reception of the request from one image formation apparatus among the plurality of image formation apparatuses;

the server performing processing for ordering a new toner bottle for the one image formation apparatus and the other image formation apparatus which satisfies the prescribed ordering condition;

the server giving a mode switching instruction instructing the image formation apparatuses for which the server has performed the ordering processing to switch to a mode for lowering the prescribed threshold value; and the image formation apparatuses lowering the prescribed threshold value from a current value in response to the mode switching instruction from the server.

14. A non-transitory recording medium storing a control program executed by a server configured to communicate with a plurality of image formation apparatuses, each image formation apparatus including a toner bottle, a storage portion configured to temporarily store toner supplied from the toner bottle, a development portion configured to receive supply of toner from the storage portion, a first detector configured to detect a remaining amount of toner in the toner bottle, a second detector configured to detect an empty space for toner in the storage portion, a controller configured to have toner supplied from the toner bottle to the storage portion each time the empty space exceeds a prescribed threshold value, and a communication unit configured to transmit a request for ordering a new toner bottle to the server when a remaining amount of toner in the toner bottle is smaller than a prescribed amount, the control program causing the server to perform:

searching, in response to reception of the request from one image formation apparatus among the plurality of image formation apparatuses, for another image formation apparatus which satisfies a prescribed ordering condition among the plurality of image formation apparatuses;

performing processing for ordering a new toner bottle for the one image formation apparatus and the other image formation apparatus which satisfies the prescribed ordering condition; and instructing the image formation apparatuses for which the server has performed the ordering processing to switch to a mode for lowering the prescribed threshold value.

* * * * *